United States Patent [19]

Rothwell, Jr. et al.

[11] 4,376,259

[45] Mar. 8, 1983

[54] HIGH INTENSITY DISCHARGE LAMP INCLUDING ARC EXTINGUISHING MEANS

[75] Inventors: Harold L. Rothwell, Jr., Rowley; Robert S. White, Jr., Beverly, both of Mass.

[73] Assignee: GTE Products Corporation, Stamford, Conn.

[21] Appl. No.: 242,074

[22] Filed: Mar. 9, 1981

[51] Int. Cl.[3] ..... H01J 7/44

[52] U.S. Cl. ..... 315/074; 315/49; 315/119; 315/362

[58] Field of Search ..... 337/142, 159, 160; 315/49, 73, 118, 119, 74, 362; 313/184

[56] References Cited

U.S. PATENT DOCUMENTS

| | | | |
|---|---|---|---|
| 1,987,711 | 1/1935 | Robinson | 315/74 |
| 2,007,927 | 7/1935 | Braselton | 315/74 |
| 2,745,284 | 5/1956 | Fitzgerald | 250/370 |
| 4,013,919 | 3/1977 | Corbley | 315/73 |
| 4,195,251 | 3/1980 | Bamberg | 315/73 |
| 4,233,542 | 11/1980 | Oostvogels et al. | 315/73 |

FOREIGN PATENT DOCUMENTS

| | | | |
|---|---|---|---|
| 267753 | 7/1970 | U.S.S.R. | 315/74 |

*Primary Examiner*—Harold A. Dixon
*Attorney, Agent, or Firm*—William H. McNeill

[57] ABSTRACT

A high intensity discharge lamp includes, within the outer envelope, a strip of niobium foil serially connected between a power source and one of the electrodes of the arc tube of the lamp. The foil is not a power consuming element but will oxidize and open the circuit, thus extinguishing the lamp, in the event the outer envelope is ruptured.

3 Claims, 4 Drawing Figures

HIGH INTENSITY DISCHARGE LAMP INCLUDING ARC EXTINGUISHING MEANS

TECHNICAL FIELD

This invention relates to high intensity discharge lamps of the type employing an arc tube within an outer envelope. Arc extinguishing means are included within the outer envelope of the lamp for interrupting power to the arc tube in the event of breakage of the outer envelope. The arc extinguishing means comprises a non-power consuming, oxidizable element which can also function as an end-of-life device.

BACKGROUND ART

High intensity discharge (HID) lamps such as mercury vapor, metal halide and high pressure sodium lamps, because of their high luminous efficacy, excellent lumen maintenance, relative low cost of light, good optical efficiency and ease of installation have been in general use for many years and are in increasing demand today. It has recently been publicized that, under certain conditions, these HID lamps may present a potential health hazard.

The light emitting member of these lamps, namely, the quartz arc tube containing mercury vapor or metal halide, and the alumina high pressure sodium discharge tube, all contain mercury is at least one of the constituent fill components. The mercury vapor lamp arc tube uses only mercury as the fill component (except for argon starting gas) and the resulting lamp discharge yields the well known mercury high pressure line spectrum with infrared, visible and ultraviolet radiation. The metal halide tube uses mercury plus combinations of various metal halide compounds as the fill components in addition to argon starting gas. The resulting spectrum will be characteristic of the metal introduced, augmented by the mercury line spectrum. The high pressure sodium lamp is filled with mercury and sodium in addition to starting gases of argon, xenon or neon or mixtures thereof. The spectrum of the discharge of this lamp is characteristic of high pressure sodium augmented by the line spectrum of mercury. Therefore, although ionized and excited mercury atoms are not the primary light producing species in metal halide and high pressure sodium arc tubes and lamps, sufficient mercury ionization and excitation occurs to produce visible and ultraviolet radiation of the characteristic mercury spectrum.

The characteristic mercury spectral lines produced by the discharges of the foregoing types of lamps produce ultraviolet radiation in the 200–297 nanometer range. Ultraviolet radiation in this range is potentially harmful. For example, conjunctivitis, an inflammation of the conjunctivae, will cause visual incapacitation and is caused by exposure to 250–297 nanometer radiation. Conjunctivitis when inflicted by exposure to the ultraviolet radiation is insidious as its symptoms do not appear until 2½ to 12 hours after exposure to such radiation. Numerous cases of ultraviolet radiation exposure causing abiotically produced cataracts of the eye lens have been reported. Even when such ultraviolet producing sources are viewed from considerable distances eye injuries can occur by ocular absorption.

Hermetically sealed outer glass envelopes are usually used to surround the light emitting tubes of HID lamps. This is done for three main reasons: (a) to obtain proper warm up and operating vapor pressures of the fill components by providing an inert gas or vacuum atmosphere between the discharge tube and the outer envelope, (b) to prevent the slow deterioration, due to oxidation, of the discharge tube lead-in wires, and (c) to prevent the lamp from radiating the harmful ultraviolet energy produced by the inner tube.

With respect to point (c), the glass composition of the outer envelope is chosen so as to achieve absorption of the ultraviolet range causing known harmful effects. Therefore, when the outer glass envelope is intact, the harmful ultraviolet radiation emitted by the discharge tube is absorbed. When, for one reason or another, the glass envelope is broken the hermetically sealed light emitting discharge tubes of these lamps will continue to operate for tens to hundreds of hours and will now emit their harmful ultraviolet radiation to the surrounding areas thus creating a health hazard to persons in those areas. An increasing number of HID lamps are used indoors where lamps, if operating with broken outer envelopes, will be of particular danger because of the likelihood of lamp installations in close proximity to people.

Various solutions to this problem have been proposed by the prior art and these solutions can broadly be defined as: (1) means sensitive to an increase in oxygen in the outer envelope, (2) means sensitive to a change in pressure in the outer envelope, and (3) spring switch means held together by the actual configuration of the glass outer envelope.

Examples of proposed solutions under item (1) above included U.S. Pat. Nos. 3,262,012 and 4,208,614 wherein an oxidizable filament is employed in the outer envelope which will burn through in the event the outer envelope breaks and admits air.

An example of an item (2) pressure sensitive device can be found in U.S. Pat. No. 4,143,301 in which a bellows switch is used in conjunction with an oxidizable filament.

An item (3) contact switch is disclosed in U.S. Pat. No. 4,156,830.

While all of the above-described solutions will work to a greater or lesser degree, problems exist with all of them.

In the devices employing an oxidizable filament, the filament is a power consuming element, at least while the lamp is starting.

The previously disclosed pressure sensitive devices are bulky and expensive and also employ, in conjunction therewith, an oxidizable filament which actually burns in the presence of oxygen.

The contact devices do not guarantee operation if the outer envelope is merely punctured at a spot remote from the switch.

DISCLOSURE OF INVENTION

It is, therefore, an object of this invention to obviate the disadvantages of the prior art.

It is another object of the invention to provide a simple, reliable arc extinguishing device which can also function as an end-of-life device.

These objects are accomplished, in one aspect of the invention, by the provision within the outer envelope of a high intensity discharge lamp of a fail-safe device operative to extinguish the lamp in the event atmospheric oxygen enters therein. The device comprises a non-power consuming, oxidizable element.

The oxidizable element can also be formed to extinguish the lamp a predetermined number of hours after the lamp has passed its normal life expectancy, even if the outer envelope is intact. Such a feature would be a desirable safety addition to such lamps since these lamps can experience catastrophic failure by explosion of the arc tube if they continue to operate for long periods after their normal life expectancy. While the exact reason for the failure of the arc tube by explosion is not known, it has been postulated that the quartz material thereof gradually weakens as a result of the high temperatures encountered therein during operation.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
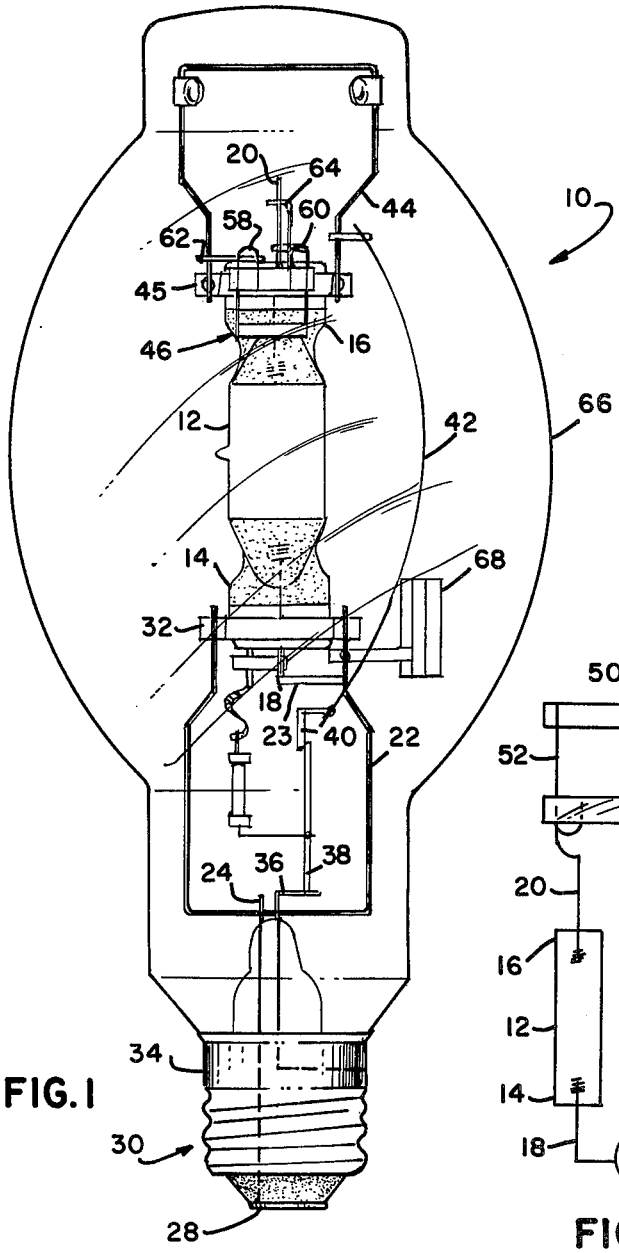
FIG. 1 is a diagrammatic, elevational view of a lamp employing the invention.
Figure 2:
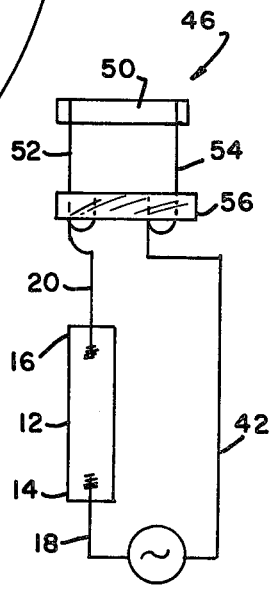
FIG. 2 is a circuit diagram of the invention.
Figure 3:
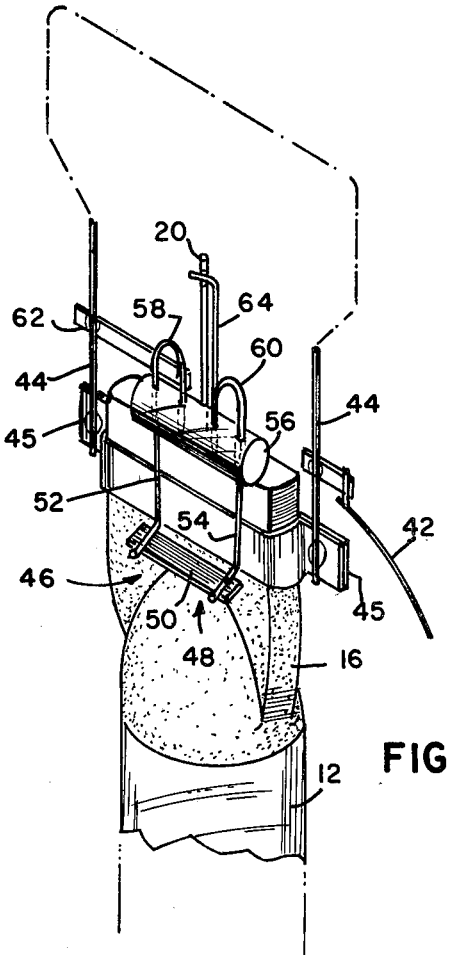
FIG. 3 is an enlarged, perspective view of the invention and a mounting therefor.

Referring now to the drawings with greater particularity, there is shown in FIG. 1 a high intensity discharge lamp 10 which comprises an inner arc discharge tube 12 of, for example, fused quartz. The ends 14, 16 of tube 12 are sealed around current carrying electrodes 18, 20.

Electrode 18 is attached to metal frame 22 by tab 23. Frame 22 is attached to metal lead-in 24 which is sealed into the glass press 26 and extends to the center conductor 28 of base 30. The arc tube 12 is affixed to frame 22 by metal retaining band 32.

The outside conductor 34, of base 30, is connected to metal lead-in 36, which also is sealed in glass press 26. Lead-in 36 is connected to metal leads 38 and 40 and flexible connector 42. The other end of connector 42 is connected to metal upper frame 44 which is mounted to arc tube retaining band 45. Serially connected between upper frame 44 and electrode 20 is a non-power consuming lamp extinguishing means 46.

Figure 4:
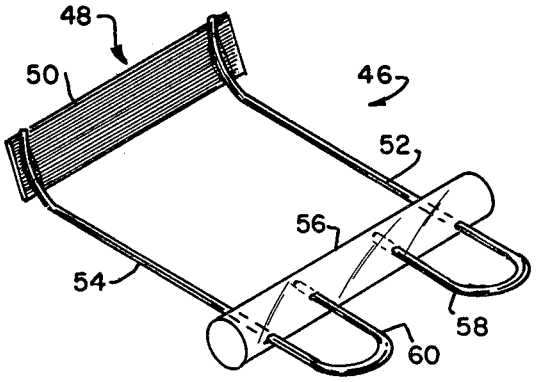
FIG. 4 is a perspective view of the fail-safe device.

The lamp extinguishing means 46 (see FIG. 4) comprises an electrically conductive oxidizable element 48, such as a strip of niobium foil 50, which can be 0.001" thick by 0.08" wide and 0.4" long. Electrical lead-wires 52 and 54 are attached to the ends of foil 50 and extend therefrom. An electrically insulating, lead-wire supporting bridge 56 of a suitable material, for example, quartz, engages the intermediate sections of lead-wires 52 and 54. Preferably, the free ends 58 and 60 of these lead-wires are folded back and inserted also in bridge 56 to further increase the structural rigidity of means 46.

Electrical connection and physical positioning of means 46 is made by attaching frame 44 to one of the lead-wires of means 46, for example, lead-wire 52, as by tab 62. The other lead-wire, 60, is attached to electrode 20, as by connector 64.

Lamp extinguishing means 46 is mounted so that foil 50 is positioned closely adjacent the surface of arc tube 12, say one to two millimeters. The foil 50, which is preferably acid etched to provide a rough surface which improves the oxidation properties of the foil 50, also has its side adjacent arc tube 12 coated with graphite to improve heat coupling with the arc tube 12.

In this orientation the niobium foil 50 reaches a temperature of about 600° C. when the lamp is operating. The volume of lamp within the outer envelope 66 is nitrogen filled, at a pressure of say 400 torr. Further, at least one $BaO_2$ getter, 68, is positioned within outer envelope 66 to provide a small (<0.1 torr) residual oxygen pressure. Under normal lamp conditions and for a normal life span (say 10,000 hrs.) the niobium foil 50 shows no deterioration with the nitrogen in the outer envelope.

However, if the outer envelope 66 is ruptured while the lamp is operating, the foil 50 will oxidize completely within 8 to 12 minutes, the time variation depending upon the closeness of the foil 50 to arc tube 12, the speed of the oxidation reaction depending not only upon the amount of oxygen present but also upon the temperature.

Since, as noted above, there is always some oxygen present within outer envelope 66, and, therefore, a slow but steady oxidation of the niobium foil 50, it is possible to use the lamp extinguishing means 46 as an end-of-life device also. That is, even though the outer envelope 66 remains intact, the foil 50 will subsequently oxidize through and open the circuit before the lamp can operate long enough to reach the point where a dangerous arc tube explosion is imminent.

There is thus provided a lamp extinguishing means which also functions as an end-of-life device. It is serially connected in the lamp circuitry but, unlike the oxidizable filaments of the prior art, is not a power consuming element.

While there have been shown and described what are at present considered the preferred embodiments of the invention, it will be apparent to those skilled in the art that various changes and modifications can be made herein without departing from the scope of the invention as defined by the appended claims.

We claim:

1. A high intensity discharge lamp comprising: an arc discharge tube operating within a given environment; an oxidizable, end-of-life device connected in series with the electrodes of said arc discharge tube; and means for providing said given environment with a residual oxygen pressure of about 0.1 torr whereby long operation of said lamp will cause slow, but continuous oxidation of said end-of-life device to eventually achieve rupture of said end-of-life device at a predetermined time, thereby opening the circuit and disabling said lamp, said predetermined time being approximately equal to the life expectancy of said lamp.

2. The lamp of claim 1 wherein said means for providing said residual oxygen pressure comprises at least one $BaO_2$ getter.

3. The lamp of claim 2 wherein said end-of-life device comprises a strip of niobium having roughened surfaces, said device being mounted closely adjacent said arc discharge tube whereby said device reaches a temperature of about 600° C. when said lamp is operating.

* * * * *